US008104617B2

(12) United States Patent
Goto et al.

(10) Patent No.: US 8,104,617 B2
(45) Date of Patent: Jan. 31, 2012

(54) OVERWRAP PACKED BODY

(75) Inventors: Yoshihiro Goto, Minato-ku (JP); Tadayoshi Teramoto, Osaka (JP); Takayuki Terada, Osaka (JP)

(73) Assignees: Kabushiki Kaisha Yakult Honsha, Tokyo (JP); Toho Shoji Kabushiki Kaisha, Osaka-Shi (JP)

( * ) Notice: Subject to any disclaimer, the term of this patent is extended or adjusted under 35 U.S.C. 154(b) by 254 days.

(21) Appl. No.: 11/631,787

(22) PCT Filed: Jul. 4, 2005

(86) PCT No.: PCT/JP2005/012349

§ 371 (c)(1),
(2), (4) Date: Jul. 18, 2008

(87) PCT Pub. No.: WO2006/004094

PCT Pub. Date: Jan. 12, 2006

(65) Prior Publication Data

US 2008/0289986 A1 Nov. 27, 2008

(30) Foreign Application Priority Data

Jul. 6, 2004 (JP) ..... 2004-199103

(51) Int. Cl.
*B65D 75/00* (2006.01)
*B65D 65/28* (2006.01)

(52) U.S. Cl. ..... 206/432; 206/497; 229/87.05

(58) Field of Classification Search ..... 206/427, 206/432, 497; 229/87.05, 89; 383/201, 207
See application file for complete search history.

(56) References Cited

U.S. PATENT DOCUMENTS

| | | | | | |
|---|---|---|---|---|---|
| 2,285,542 | A | * | 6/1942 | Tasker | 229/87.05 |
| 3,348,671 | A | * | 10/1967 | Wood | 206/194 |
| 3,542,193 | A | * | 11/1970 | Hewlett et al. | 206/497 |
| 3,587,910 | A | * | 6/1971 | McCarthy | 206/427 |
| 3,618,757 | A | | 11/1971 | Funkhouser | |
| 3,687,282 | A | * | 8/1972 | Owen | 206/432 |
| 3,746,160 | A | * | 7/1973 | Thompson et al. | 206/497 |
| 4,382,506 | A | * | 5/1983 | Chaussadas | 206/432 |
| 4,696,402 | A | * | 9/1987 | Harmon et al. | 229/120.011 |
| 4,830,895 | A | * | 5/1989 | Bernard | 206/432 |
| 4,971,197 | A | | 11/1990 | Worley | |
| 5,386,752 | A | | 2/1995 | Siegel | |
| 6,050,058 | A | * | 4/2000 | Loreto et al. | 206/432 |
| 6,105,776 | A | | 8/2000 | Meilhon | |
| 6,820,745 | B1 | | 11/2004 | Ono | |
| 2002/0177513 | A1 | | 11/2002 | Focke et al. | |

FOREIGN PATENT DOCUMENTS

| | | | |
|---|---|---|---|
| CN | 1388050 | A | 1/2003 |
| CN | 2589373 | Y | 12/2003 |
| EP | 1422158 | A1 | 5/2004 |
| JP | 48-012281 | U | 2/1973 |
| JP | 54-32399 | B2 | 10/1979 |
| JP | 57-186362 | U | 11/1982 |
| JP | 58-036097 | U | 3/1983 |
| JP | 3-043122 | B | 7/1991 |
| JP | 03-111971 | U | 11/1991 |
| JP | 6-051487 | B | 7/1994 |
| JP | 7-4891 | B2 | 1/1995 |
| JP | 8-029784 | B2 | 3/1996 |
| JP | 2502860 | B2 | 3/1996 |
| JP | 2525158 | B2 | 5/1996 |
| JP | 2731474 | B2 | 12/1997 |
| JP | 2789524 | B2 | 6/1998 |
| JP | 10-287360 | A | 10/1998 |
| JP | 11-091821 | A | 4/1999 |
| JP | 2002-362621 | A | 12/2002 |
| JP | 2003-095225 | A | 4/2003 |
| JP | 2003-104330 | A | 4/2003 |
| JP | 2003-104335 | A | 4/2003 |
| JP | 2003-300538 | A | 10/2003 |
| JP | 2004-170634 | A | 6/2004 |
| WO | 99/52788 | A1 | 10/1999 |

OTHER PUBLICATIONS

Chinese Office Action dated Feb. 27, 2009.
New Zealand Office Action dated Apr. 21, 2009.
Extended European Search Report issued Nov. 18, 2010, in counterpart European Application No. 05765256.2.
Japanese Notice of Reason of Rejection, dated Feb. 3, 2010, issued in Application No. 2005-190884.
Japanese Office Action, dated Nov. 12, 2010, issued in Application No. 2005-190884.

* cited by examiner

*Primary Examiner* — Bryon Gehman
(74) *Attorney, Agent, or Firm* — Sughrue Mion, PLLC

(57) ABSTRACT

An overwrap packed body is obtained by heating and shrinking a wrapping material in a condition that five drink products collectively wrapped by the wrapping material. Three perforated lines passing through gap portions between the adjacent drink products are formed on the wrapping material at an interval of 2 mm in parallel. When the three perforated line portions are pushed with fingers in the gap portion between the adjacent drink products, the wrapping material torn from the pushed portion in a vertical direction. Thus, the packed drink products DG can be easily taken out one by one.

6 Claims, 15 Drawing Sheets

OVERWRAP PACKED BODY

TECHNICAL FIELD

The present invention relates to an overwrap packed body in which a plurality of objects to be packed are wrapped with a wrapping material constituted by a shrink film and an overwrap packing is carried out thereto. In addition, the present invention relates to a perforated line forming method and apparatus for forming a plurality of perforated lines on the wrapping material in parallel, and more particularly to a perforated line forming method and a perforated line forming apparatus which are useful in the case in which an interval between perforated lines is small.

BACKGROUND ART

Disclosed in FIG. 13 is a drink product DG obtained by filling a plastic vessel V having a small capacity with a drink. As shown in FIG. 14, to the drink products DG, an overwrap packing is carried out by using a wrapping material PM constituted by a biaxially stretched film having a thermal shrinking property in order to integrally handle a plurality of drink products DG. In an overwrap packed body in which a plurality of drink products DG are wrapped with the wrapping material, as shown in FIG. 14, a small hole p is formed on the wrapping material PM in each gap portion between the adjacent drink products DG. The wrapping material PM is broken when a small hole P portion is pushed with fingers, and the packed drink product DG can be thus taken out.

However, when the overwrap packing is carried out over the drink products DG by using the wrapping material PM provided with the small hole p in advance, there is a possibility that the small hole p formed on the wrapping material PM might depart the gap portion between the adjacent drink products DG. That is, it is difficult to surely form the small hole p in the gap portion between the adjacent drink products DG in the overwrap packed body. Furthermore, a sufficient breaking property cannot be maintained by only the formation of the small hole p on the wrapping material PM as a starting point for breaking the wrapping material PM.

In addition, when the perforated line formed on a thin film forming a wrapping material, the following method is employed, in related art of the present invention. That is, as shown in FIG. 15, there are used a cutter roller CR having a large number of perforated line forming blades c provided at a predetermined interval over a whole periphery and a guide roller GR provided with a peripheral groove g for receiving the perforated line forming blade c of the cutter roller CR.

The film F is fed on the guide roller GR, and the cutter roller CR is rotated in a state in which the perforated line forming blade c is inserted into the peripheral groove g formed on the guide roller GR. At the peripheral groove g portion formed on the guide roller GR, a perforated line is formed on the film F, by sequentially sticking the perforated line forming blade c to the film F.

When a plurality of perforated lines are formed on the wrapping material in parallel at a small interval, the plurality of perforated lines are formed at the same time by forming a plurality lines of perforated line forming blades c on the single cutter roller CR, in the related art. However, if the interval between the perforated lines is small, it is difficult to individually form, on the guide roller GR, a plurality of peripheral grooves g respectively formed for receiving the plurality lines of perforated line forming blades c. Thus, as shown in FIG. 16 as related art of the present invention, a single peripheral groove g1 for receiving the whole lines of perforated line forming blades c is formed on the guide roller GR.

When a plurality of perforated lines is to be formed at the same time in the wide peripheral groove g1 portion for receiving the whole lines of perforated line forming blades c, the amount of elongation and that of shift in the film F in the peripheral groove g1 portion are more increased as compared with the case in which a plurality of peripheral grooves is individually formed on the guide roller for each of the perforated line forming blades. Therefore, as shown in FIG. 16, the amount of sticking of the perforated line forming blade c to the film F is reduced. Particularly, the amount of sticking of the perforated line forming blade c constituting a central line is reduced. As a result, a proper perforated line cannot be reliably formed.

Moreover, if close perforated lines are formed at the same time even in the case the peripheral grooves g for individually receiving the plurality lines of perforated line forming blades c is formed on the single guide roller GR, both side portions of each of the perforated line forming blades c in the film F are stretched toward the respective perforated line forming blade c sides, when the perforated line forming blade c sticks to the film F. Therefore, that the film F is broken at a cut portion constituting the perforated line formed on the film F by a tensile force and the film F is thus apt to be damaged.

DISCLOSURE OF THE INVENTION

In accordance with one or more embodiments of the present invention, an overwrap packed body is provided with a plurality of objects to be packed, a wrapping material that wraps the plurality of objects to be packed, and a plurality of perforated lines formed in parallel and passing through a gap portion between the adjacent objects to be packed.

In accordance with one or more embodiments of the present invention, each of the plurality of objects to be packed has a shoulder portion and has a vertically long and cylindrical shape, the plurality of objects to be packed are arranged in line in a horizontal direction, and the plurality of perforated lines extend in line in the horizontal direction across shoulder portions of the plurality of objects to be packed.

In accordance with one or more embodiments of the present invention, an interval between adjacent ones of the plurality of perforated lines is 1 to 3 mm.

In accordance with one or more embodiments of the present invention, each of the plurality of perforated lines comprises a plurality of cuts arranged in line, and the plurality of cuts are formed at a pitch of 0.5 to 3.0 mm.

In accordance with one or more embodiments of the present invention, phases of adjacent ones of the plurality of perforated lines are shifted from each other.

In accordance with one or more embodiments of the present invention, in a perforated line forming method for forming a plurality of perforated lines in parallel, the method is provided with forming one part of the plurality of perforated lines on a film, and forming the other part of the plurality of perforated lines adjacent to the one part on the film formed with the one part.

In accordance with one or more embodiments of the present invention, the plurality of perforated lines comprises three lines of the perforated lines, the one part comprises two outer lines, and the other part comprises one inner line.

In accordance with one or more embodiments of the present invention, in a perforated line forming method for forming a plurality of perforated lines in parallel, wherein each of the plurality of perforated lines comprises a plurality of cuts arranged in line, the method is provided with forming a cut in one of the perforated lines and a cut in the other of the perforated lines at shifted timing.

In accordance with one or more embodiments of the present invention, in a perforated line forming apparatus for forming a plurality of perforated lines in parallel, the apparatus is provided with a plurality of cutter rollers, each having a perforated line forming blade, and adjacent ones of the plurality of perforated lines are formed by respective perforated line forming blades on one of the plurality of cutter rollers and the other of the plurality of cutter rollers.

In accordance with one or more embodiments of the present invention, the apparatus is further provided with a guide roller including a peripheral groove for receiving the perforated line forming blade.

In accordance with one or more embodiments of the present invention, in a perforated line forming apparatus for forming a plurality of perforated lines in parallel, the apparatus is provided with a cutter roller including a plurality lines of perforated line forming blades, and adjacent ones of the plurality of perforated lines are formed by respective perforated line forming blades on one of the plurality lines and the other of plurality lines, wherein phases of the one and the other are shifted.

In accordance with one or more embodiments of the present invention, the apparatus is further provided with a guide roller including a peripheral groove for receiving the perforated line forming blade.

Other aspects and advantages of the invention will be apparent from the following description and the appended claims.

BRIEF DESCRIPTION OF THE DRAWINGS

FIG. 5(*b*) is a partial sectional view showing a cutter roller and a guide roller on a downstream side which constitute the perforated line forming apparatus shown in FIG. 3.

FIG. 6(*b*) is a front view showing an edge of the perforated line forming blade shown in FIG. 6(*a*).

FIG. 6(*c*) is a side view showing the perforated line forming blade shown in FIG. 6(*a*).

FIG. 7(*b*) is a plan view showing a cutter line employing the variant embodiment of the perforated line forming blade shown in FIG. 6(*a*).

DESCRIPTION OF THE REFERENCE NUMERALS AND SIGNS

OP overwrap packed body
DG drink product
PM wrapping material
MM perforated line
1, 2, 3 perforated line forming apparatus
10*a*, 10*b*, 10*c*, 10*d* guide roller
11*a*, 11*b*, 11*c*, 11*d* peripheral groove
20*a*, 20*b*, 20*c*, 20*d*, 20*e*, 20*f*, 20*g* cutter roller
21*a*, 21*b*, 21*c*, 21*d*, 21*e*, 21*g*, 23, 24 cutter line
22, 25 perforated line forming blade

BEST MODE FOR CARRYING OUT THE INVENTION

One or more embodiments of the invention will be described with reference to the accompanying drawings.

Figure 1:
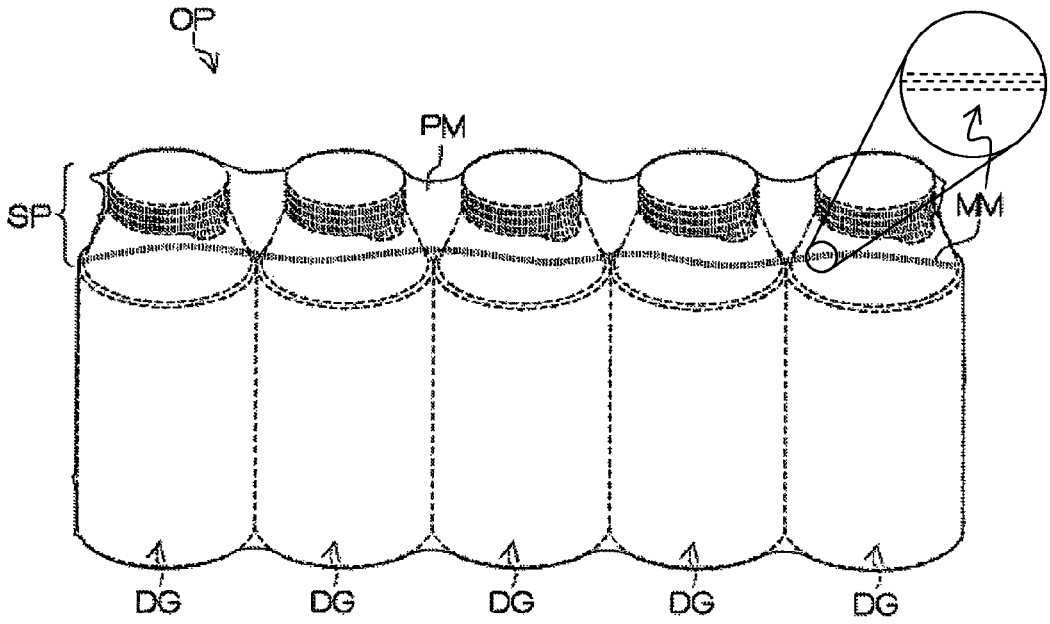
FIG. 1 is a perspective view showing an overwrap packed body according to one or more embodiments of the present invention in which a plurality of drink products is wrapped with a wrapping material.

Disclosed in FIG. 1 is an overwrap packed body OP in which a plurality of drink products DG are straightly arranged in a horizontal line and wrapped with a wrapping material PM. Each drink product DG is constituted by a plastic vessel with a top surface, a vertically long and cylindrical shape with an axis extending in a vertical direction. The vessel is filled with a drink. As the wrapping material PM, for example, a biaxially stretched polypropylene film having a thermal shrinking property in a thickness of 15 μm is used. In a embodiment of FIG. 1, five drink products DG are collectively wrapped, and the wrapping material PM is heated and shrank. In the wrapping material PM, three perforated lines MM, passing through gap portions between the adjacent drink products DG and straightly extending across respective inclined shoulder portions SP of the drink products DG, are formed in parallel. Each interval between the adjacent perforated lines is 2 mm.

Figure 2:
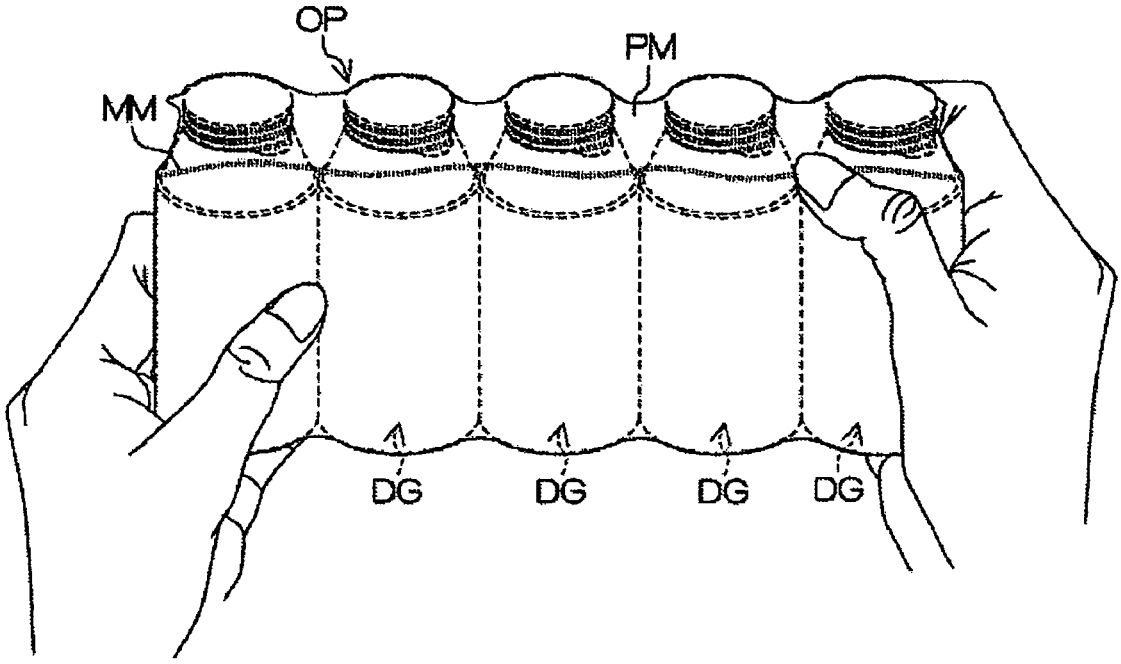
FIG. 2 is a perspective view showing a method of opening the overwrap packed body shown in FIG. 1.

When the three perforated line MM portions are pushed with fingers in the gap portion between the adjacent drink products DG in the wrapping material PM in the overwrap packed body OP as shown in FIG. 2, the wrapping material PM is torn in a vertical direction from the pushed portion so that the packed drink products DG can be easily taken out one by one.

Particularly, in the over wrap packed body OP, the perforated line MM is formed as a starting point for tearing the wrapping material PM. Therefore, differently from a conventional overwrap packed body employing a small hole as the starting point for tearing the wrapping material, it is not necessary to consider the positional shift of the wrapping material PM in a direction in which the drink products DG are adjacent to each other when the five drink products DG are to be wrapped with the wrapping material PM. Consequently, it is possible to reliably form the starting point for tearing the wrapping material PM in the gap portions between the adjacent drink products DG.

Moreover, since the three perforated lines MM are formed at an interval of 2 mm in parallel as the starting point for tearing the wrapping material PM, as compared with a conventional overwrap packed body in which only one small hole is formed as the staring point for tearing the wrapping material, tearing in a vertical direction can be easily occurred, so that the tearing property of the wrapping material PM can be more enhanced.

In order to prevent the wrapping material PM from being broken in a state of the normal handling of freight and to maintain an excellent opening property, it is desirable that the length of each cut (hole) should be set to be 0.1 to 0.8 mm and a pitch (a distance from one of the ends of the cut to one of the ends of an adjacent cut) should be set to be approximately 0.5 to 3.0 mm in the perforated line MM to be formed on the wrapping material PM.

Figure 3:
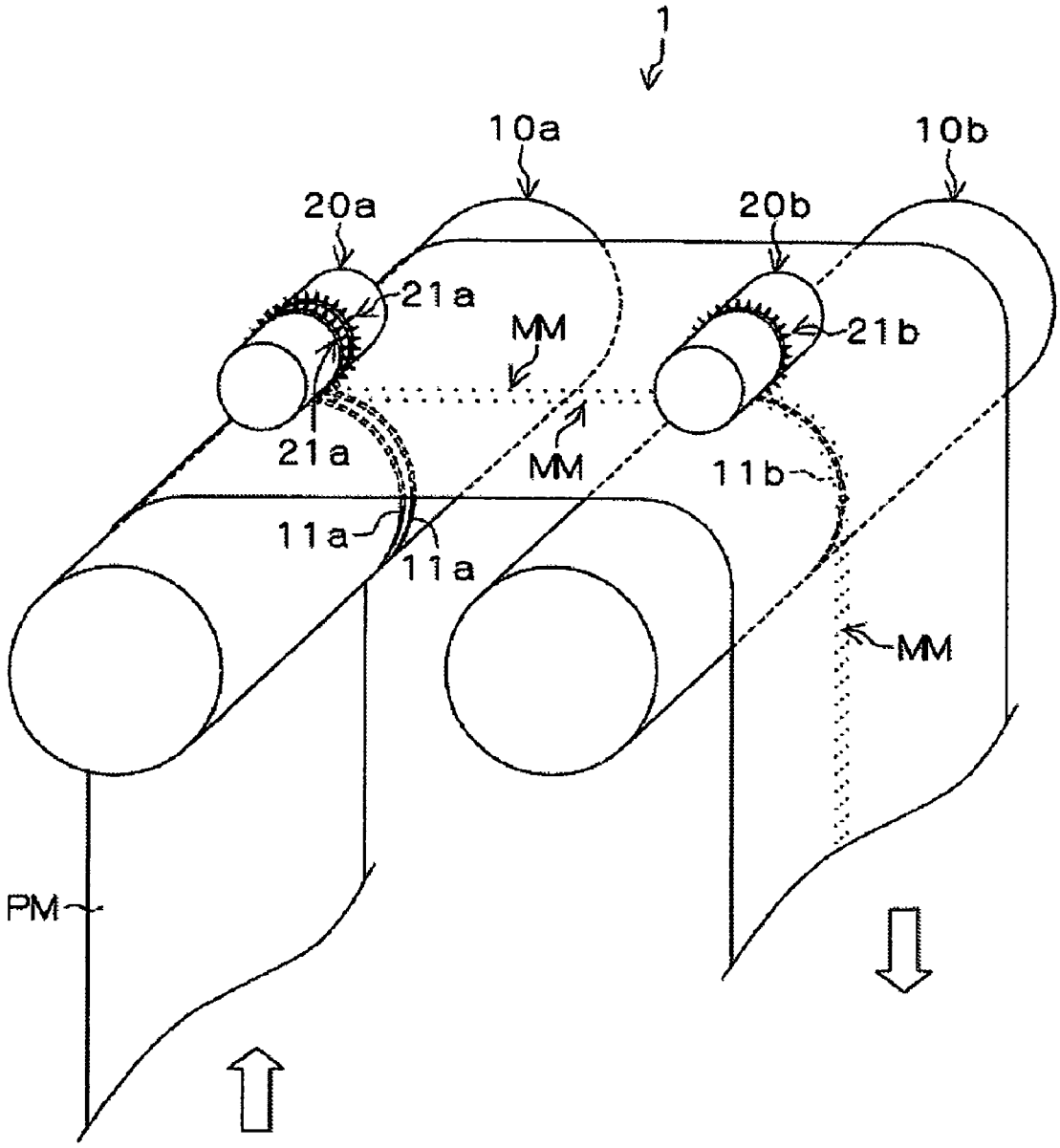
FIG. 3 is a schematic view showing a perforated line forming apparatus for forming perforated lines on a wrapping material constituting the overwrap packed body shown in FIG. 1.
Figure 4:
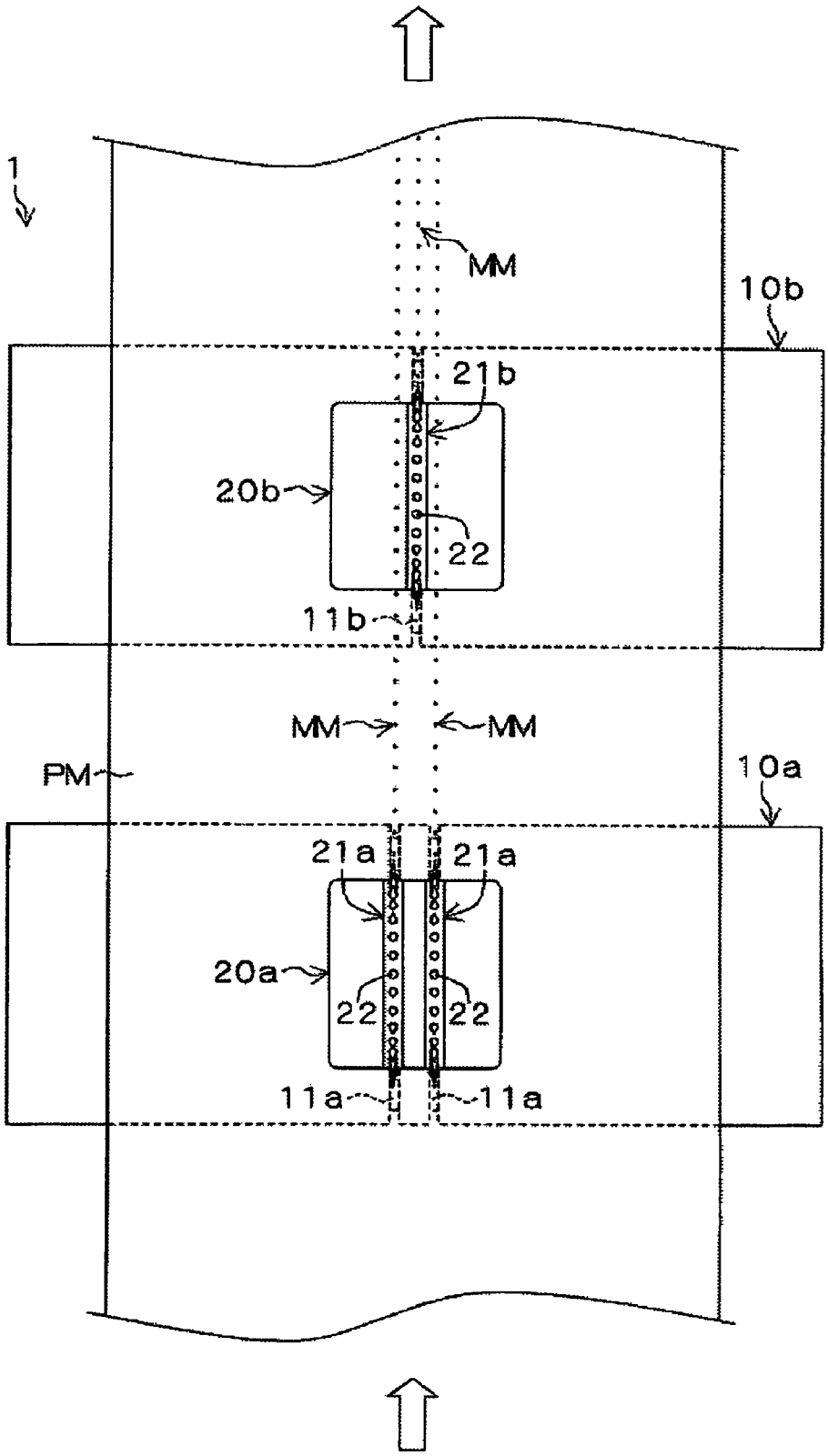
FIG. 4 is a plan view showing the perforated line forming apparatus shown in FIG. 3.

The three perforated lines MM are continuously formed on the long band-shaped wrapping material PM for wrapping the drink products DG by a perforated line forming apparatus 1 shown in FIGS. 3 and 4. The perforated line forming apparatus 1 is incorporated as a part of a wrapping apparatus. FIG. 4 shows a state in which the wrapping material PM guided in a vertical direction on the upstream and downstream sides of the perforated line forming apparatus 1 is spread out in a transverse direction in order to easily understand the state in which the perforated line MM is formed on the wrapping material PM.

As shown in FIG. 3, the perforated line forming apparatus 1 is provided with guide rollers 10*a* and 10*b* formed of a metal and cutter rollers 20*a* and 20*b* arranged just above the guide rollers 10*a* and 10*b*. The long band-shaped wrapping material PM fed from a wrapping material roll is put on the guide rollers 10*a* and 10*b*. The wrapping material PM is interposed between the guide rollers 10*a* and 10*b* and the cutter rollers 20*a* and 20*b*. The cutter rollers 20*a* and 20*b* have cutter lines 21*a* and 21*b*, and a large number of perforated line forming blades 22 formed like a needle (conically) protrude from an outer peripheral surface at a predetermined interval over a whole periphery of the cutter rollers 20*a* and 20*b*.

Figure 5A:
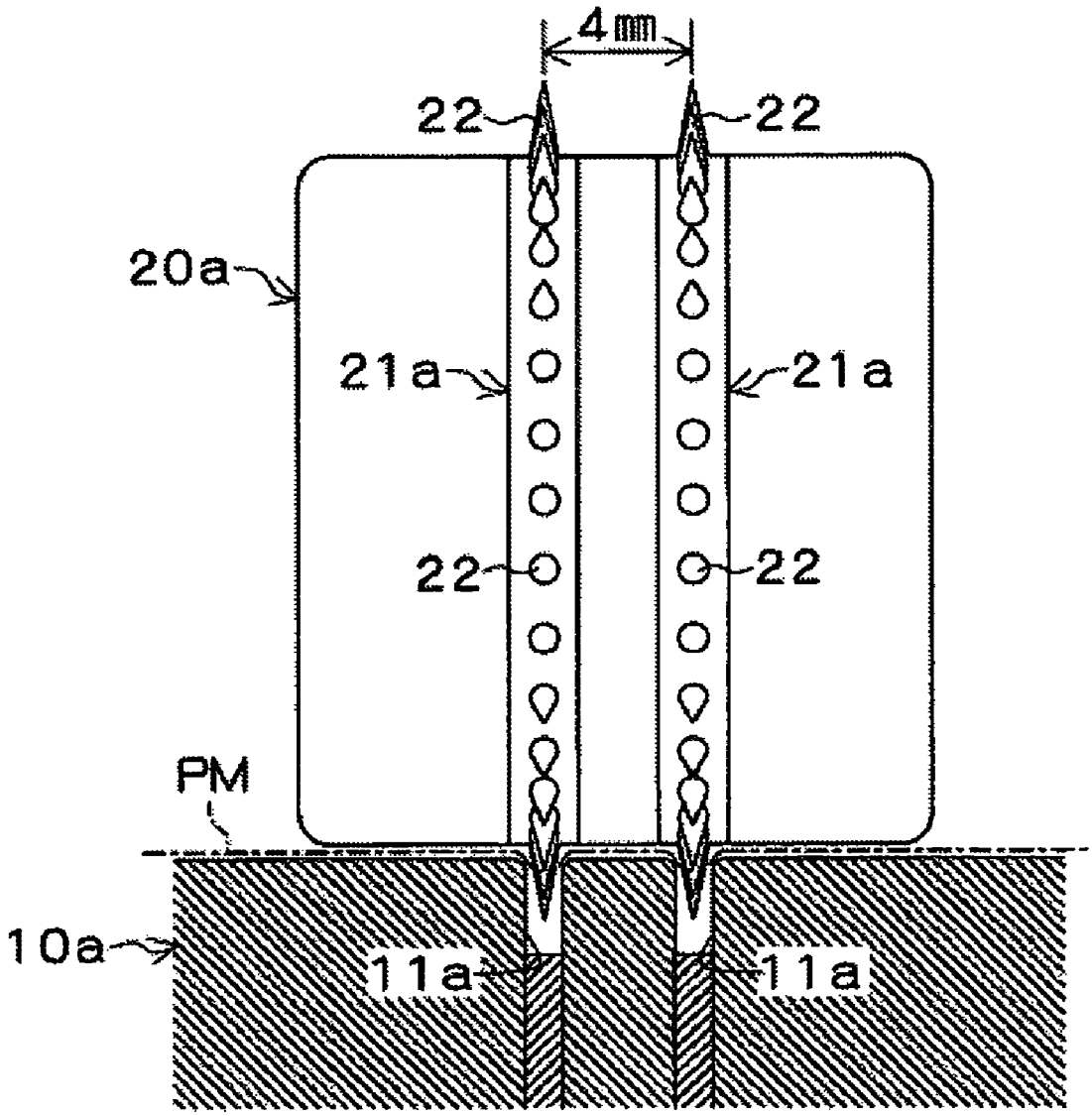
FIG. 5(*a*) is a partial sectional view showing a cutter roller and a guide roller on an upstream side which constitute the perforated line forming apparatus shown in FIG. 3.
Figure 5B:
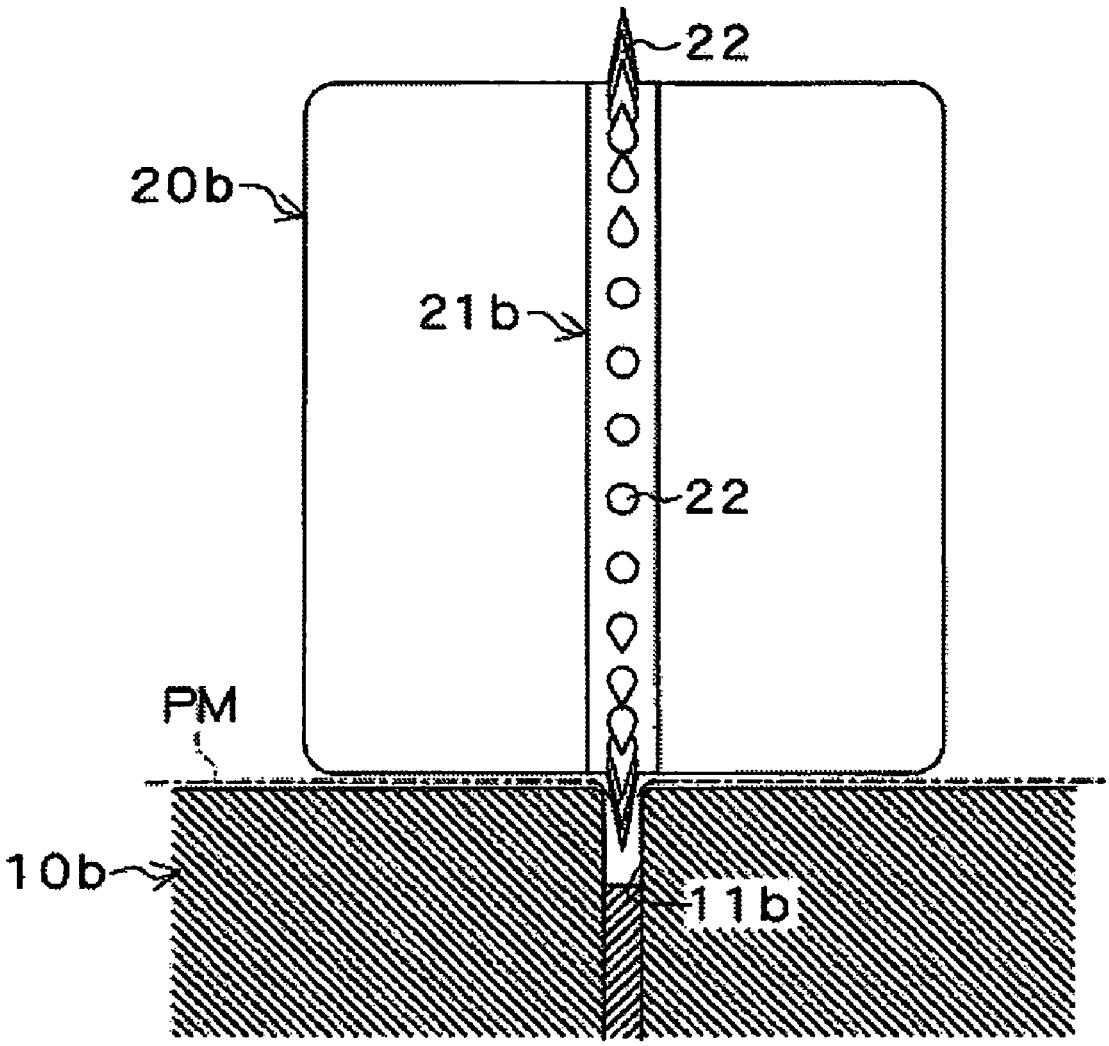

As shown in FIG. 5(*a*), the cutter roller 20*a* disposed on the upstream side in the direction of the feed of the wrapping material PM has a pair of cutter lines 21*a* and 21*a* for forming two outer perforated lines MM in the three perforated lines MM and provided at an interval of 4 mm in the transverse direction of the roller. On the outer peripheral surface of the guide roller 10*a* corresponding to the cutter roller 20*a*, peripheral grooves 11*a* and 11*a* are formed in order to respectively correspond to the respective cutter lines 21*a* and 21*a*. Each of the peripheral grooves 11*a* and 11*a* has a width of 1 mm and a depth of 2 mm, and receives respective one of the perforated line forming blades 22.

As shown in FIG. 5(*b*), the cutter roller 20*b* disposed on the downstream side in the direction of the feed of the wrapping material PM has the cutter line 21*b* for forming one inner perforated line MM in the three perforated lines MM, and provided on a center in the transverse direction of the roller. A peripheral groove 11*b* having a width of 1 mm and a depth of 2 mm for receiving the perforated line forming blade 22 constituting the cutter line 21*b* is formed on the outer peripheral surface of the guide roller 10*b* corresponding to the cutter roller 20*b* in order to correspond to the cutter line 21*b*.

In the perforated line forming apparatus 1 having the structure described above, the long band-shaped wrapping material PM fed from the wrapping material roll passes through the guide roller 10*a*, firstly. In that case, the perforated line forming blades 22 constituting a pair of cutter lines 21*a* and 21*a* in the cutter roller 20*a* sequentially stick to the wrapping material PM in the peripheral groove 11*a* and 11*a* portions in the guide roller 10*a*. Consequently, the two outer perforated lines MM in the three perforated lines MM are formed on the wrapping material PM.

The wrapping material PM having the two perforated lines MM thus formed thereon subsequently passes through the guide roller 10*b*. When passing through the guide roller 10*b*, the perforated line forming blade 22 constituting the cutter line 21*b* in the cutter roller 20*b* sequentially sticks to the wrapping material PM in the peripheral groove 11*b* portion in the guide roller 10*b*. Consequently, the one inner perforated line MM in the three perforated lines MM is formed on the wrapping material PM. As a result, the three perforated lines are formed on the wrapping material PM.

As described above, in the perforated line forming apparatus 1, the two outer perforated lines MM are firstly formed on the wrapping material PM by the guide roller 10*a* and the cutter roller 20*a* which are provided on the upstream side and the one inner perforated line is then formed on the wrapping material PM by means of the guide roller 10*b* and the cutter roller 20*b* which are provided on the downstream side in such a manner that the adjacent perforated lines MM are not formed at the same time. Even if the interval among the three perforated lines MM to be formed on the wrapping material PM is small, therefore, the peripheral grooves 11*a* and 11*a* for receiving the perforated line forming blades 22 constituting the cutter lines 21*a* and 21*a* of the cutter roller 20*a* respectively can be formed on the guide roller 10*a* in an independent state for the respective cutter lines 21*a* and 21*a*.

Accordingly, in the perforated line forming apparatus 1, when the perforated line forming blades 22 constituting the cutter lines 21*a* and 21*a* of the cutter rollers 20 a respectively are to stick to the wrapping material PM, the amount of elongation and that of shift in the wrapping material PM can be minimized. Therefore, the amount of sticking of the perforated line forming blade 22 to the wrapping material PM can be prevented from being reduced. Thus, it is possible to reliably form a proper perforated line MM.

Moreover, in the perforated line forming apparatus 1, since the perforated lines MM which are adjacent to each other are not formed at the same time, a tensile force applied to the cut portions constituting the two outer perforated lines MM formed at the same time is small. Therefore, it is difficult that the wrapping material PM is broken at the cut portions as a starting point. As a result, it is possible to form a fine perforated line MM without damaging the wrapping material PM.

If the one inner perforated line MM is firstly formed and the two outer perforated lines MM are then formed, both side portions of the cut constituting the one perforated line MM formed earlier are stretched outward when the two outer perforated lines MM are to be formed. For this reason, the wrapping material PM is easily broken at the cut portion constituting the one perforated line MM formed earlier. However, in the perforated line forming apparatus 1, the two outer perforated lines MM are firstly formed and the one inner perforated line MM is then formed. Therefore, when the one inner perforated line MM is to be formed, the either side portion of the cut constituting each of the two perforated lines MM formed earlier is simply stretched inward. Consequently, it is also possible to obtain an advantage that the wrapping material PM is broken with difficulty at the cut portions constituting the two perforated lines MM formed earlier respectively.

While the conical perforated line forming blade 22 having the diameter of a base end set to be 0.6 mm is employed in the embodiment, this is not restricted. It is preferable to properly set the shape and dimension of the perforated line forming blade in consideration of the function of a perforated line to be formed. It is desirable that at least a tip portion should be conical and the diameter of the base end should be set to be approximately 0.5 to 1.5 mm.

While the widths of the peripheral grooves 11*a* and 11*b* formed on the guide rollers 10*a* and 10*b* are set to be 1 mm in the embodiment, moreover, they are not restricted thereto but the width of the peripheral groove to be formed on the guide roller is preferably set properly corresponding to the diameter of the base end of the perforated line forming blade to be employed. In the case in which the perforated line forming blade having the diameter of the base end set to be approximately 0.5 to 1.5 mm is employed, for example, it is desirable that the width of the peripheral groove to be formed on the guide roller should be set to be approximately 0.7 to 2.0 mm.

Figure 6A:
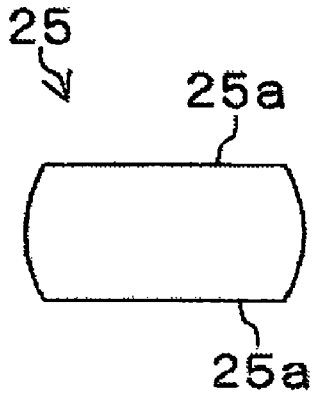
FIG. 6(*a*) is a plan view showing a variant embodiment of a perforated line forming blade.
Figure 6B:
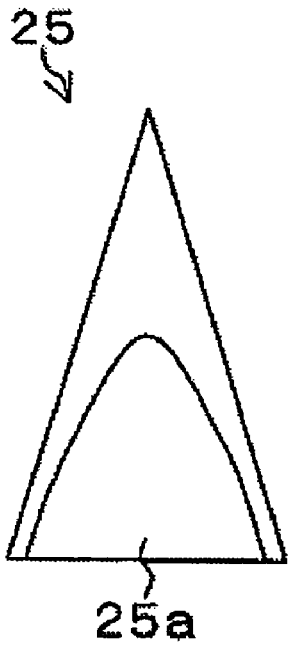
Figure 6C:
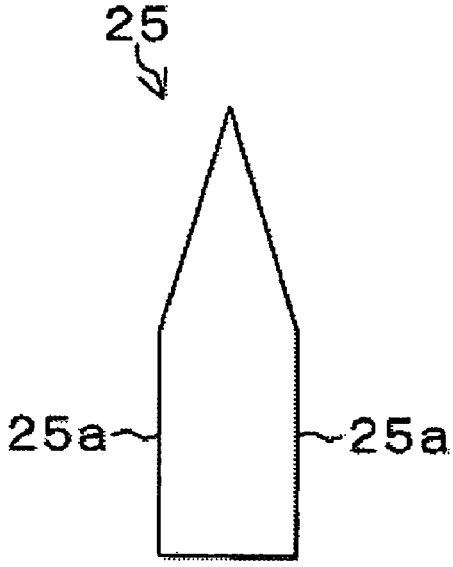

Further, while the conical perforated line forming blade 22 is used in the embodiment, this is not restricted. For example, it is also possible to employ a perforated line forming blade 25 having a base end provided flatly by partially removing the base end of the conical perforated line forming blade as shown in FIG. 6(*a*) to FIG. 6(*c*). In the case in which such a perforated line forming blade 25 is to be used, it is also possible to use a cutter line 23 provided with a large number of perforated line forming blades 25 at a predetermined interval in such a manner that a cut surface 25*a* of each perforated line forming blade 25 is turned in the circumferential direction of the cutter roller as shown in FIG. 7(*a*) or to use a cutter line 24 provided with a large number of perforated line forming blades 25 at a predetermined interval in such a manner that the cut surface 25*a* of the perforated line forming blade 25 is turned in the transverse direction of the cutter roller as shown in FIG. 7(*b*).

Figure 7A:
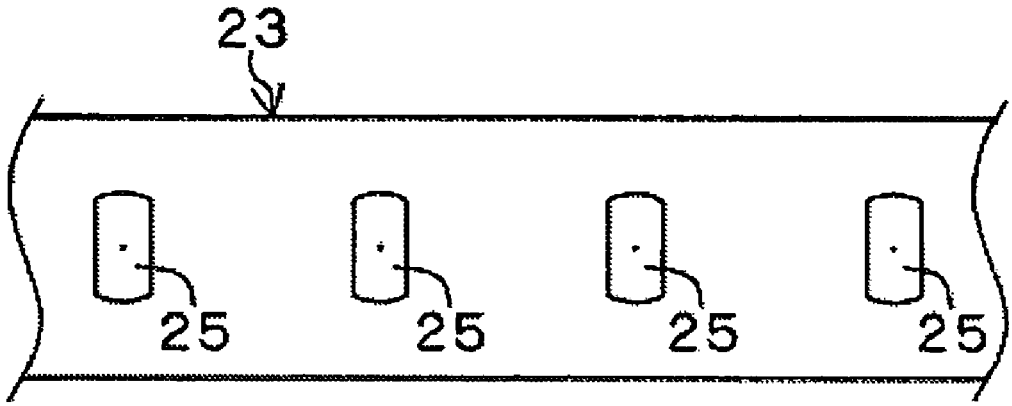
FIG. 7(*a*) is a plan view showing a cutter line employing the variant embodiment of the perforated line forming blade shown in FIG. 6(*a*).
Figure 7B:
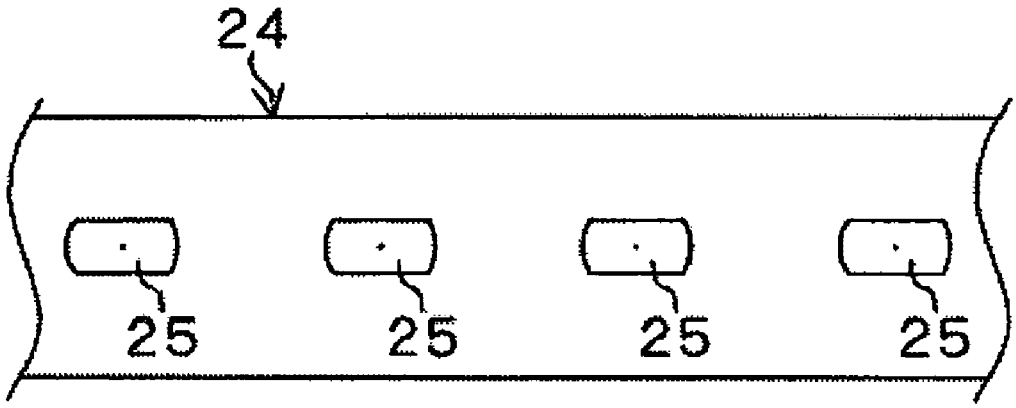

When a perforated line is formed on the wrapping material by using a cutter roller employing the cutter line 23 shown in FIG. 7(*a*), respective cuts (holes) constituting the perforated lines which are formed become long in an orthogonal direction to the perforated line so that the wrapping material is easily torn in the orthogonal direction to the perforated line. Therefore, it is possible to obtain an advantage that the overwrap packed body OP shown in FIG. 1 is easily torn in a vertical direction. In a cutter roller employing the cutter line 24 shown in FIG. 7(*b*), moreover, the width of the base end in the perforated line forming blade 25 is small. Consequently, it is possible to obtain an advantage that the perforated line forming blade 25 is jammed with the wrapping material with difficulty and the perforated line can be thus formed easily when the perforated line forming blade 25 sticking to the wrapping material is to be removed from the wrapping material.

While the two outer perforated lines MM are formed and the one inner perforated line MM is then formed so that the three perforated lines MM are formed in the embodiment, moreover, this is not restricted but it is also possible to form the one inner perforated line MM and to then form the two outer perforated lines MM or to form the three perforated lines MM by a division into three stages for each of them.

While the description has been given to the case in which the three perforated lines MM are formed in the embodiment, moreover, this is not restricted. It is apparent that the perforated line forming method according to the invention can also be applied to the case in which two perforated lines or four perforated lines or more are to be formed. For example, in the case in which four perforated lines are to be formed, they are formed one by one by a division into four stages or a first perforated line and a third perforated line are formed at the same time and a second perforated line and a fourth perforated line are then formed at the same time. Thus, it is preferable to form the four perforated lines stepwise so as not to form the adjacent perforated lines at the same time.

Moreover, it is sufficient that a position in which the perforated line is to be formed is properly determined depending on the shape of an object to be packed, and it is preferable that the perforated lines should be formed to pass through a gap between the objects to be packed. For example, in case of the overwrap packed body OP shown in FIG. 1, it is preferable to form the perforated line to pass through a shoulder portion SP of the drink product DG. In particular, it is preferable to form the perforated line in the upper part of the shoulder portion SP of the drink product DG.

Second Embodiment

Figure 8:
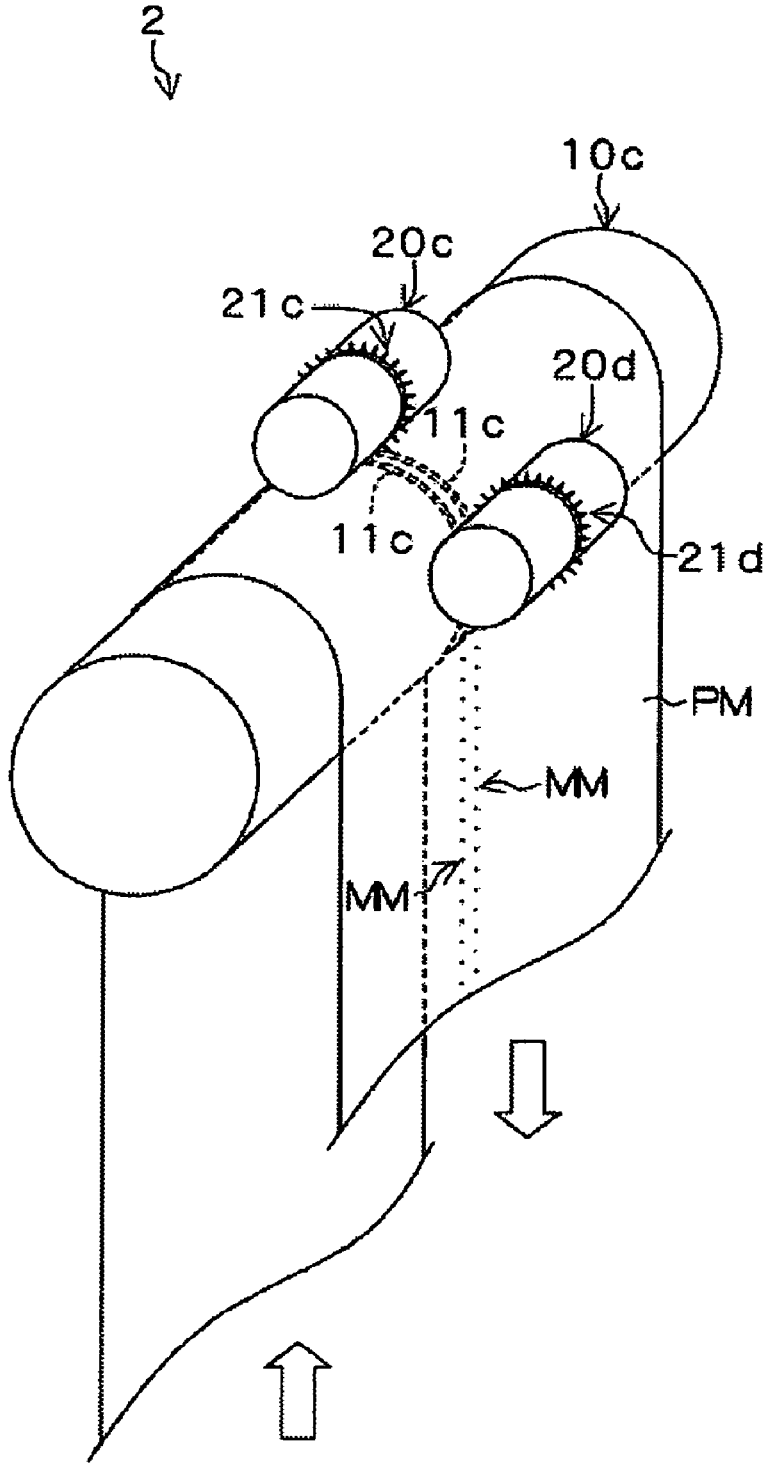
FIG. 8 is a schematic view showing a perforated line forming apparatus according to one or more embodiments of the present invention.

Disclosed in FIG. 8 is a perforated line forming apparatus 2 according to a second embodiment of the present invention. In the perforated line forming apparatus 2, two peripheral grooves 11*c* and 11*c* are formed on a single guide roller 10*c*. Two cutter rollers 20*c* and 20*d* having cutter lines 21*c* and 21*d* are respectively arranged in different positions on the circumference of the guide roller 10*c*. As a result, two adjacent perforated lines MM are formed stepwise in the same guide roller 10*c* portion.

Third Embodiment

Figure 9:
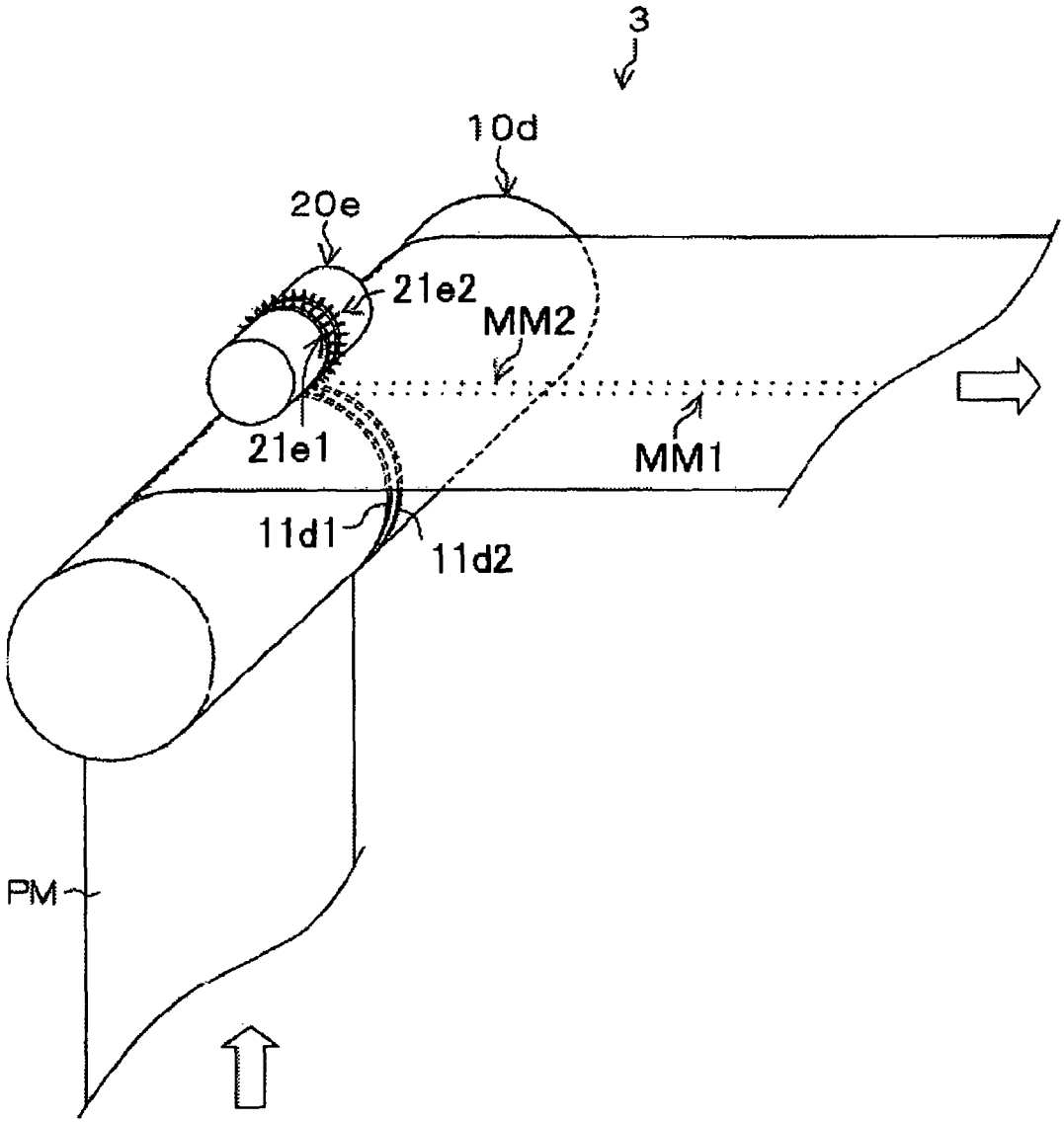
FIG. 9 is a schematic view showing a perforated line forming apparatus according to one or more embodiments of the present invention.

Disclosed in FIG. 9 is a perforated line forming apparatus 3 according to a third embodiment of the present invention.

The perforated line forming apparatus 3 is provided with a single guide roller 10*d* and a single cutter roller 20*e*. On the cutter roller 20*e*, two cutter lines 21*e*1 and 21*e*2 are provided.

Figure 10:
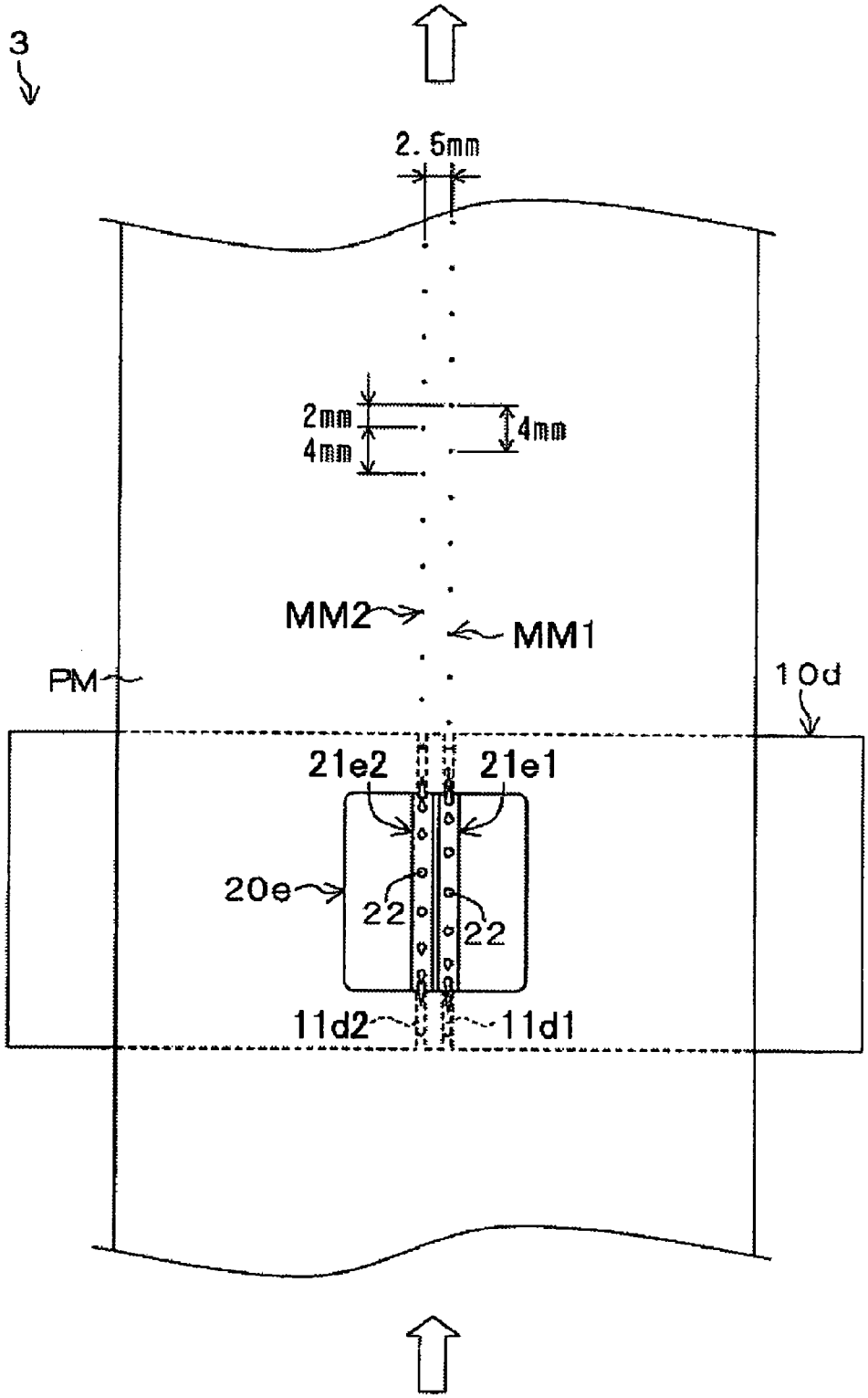
FIG. 10 is a plan view showing the perforated line forming apparatus shown in FIG. 9.

On the guide roller 10*d*, two peripheral grooves 11*d*1 and 11*d*2 are formed so as to respectively correspond to the two cutter lines 21*e*1 and 21*e*2. Phases of the two cutter lines 21*e*1 and 21*e*2 are shifted to approximately 2 mm at positions where holes in the perforated lines are formed. As a result, as shown in FIG. 10, the hole in the perforated line MM1 formed by the cutter line 21*e*1 and the hole in the perforated line MM2 formed by the cutter line 21*e*2 are shifted to approximately 2 mm. An interval between the cutter lines 21*e*1 and 21*e*2 is approximately 2.5 mm. Moreover, an interval (a pitch) between cuts (holes having a diameter of 0.4 mm) in each perforated line MM1 and MM2 is 4 mm. When the interval between the adjacent perforated lines MM1 and MM2 is approximately 2.5 mm, by arranging two cutter lines 21*e*1 and 21*e*2 within shifted phases on the single cutter roller 20*e*, it is possible to form adjacent perforated lines MM1 and MM2. As a result, according to the third embodiment, it is possible to downsize the apparatus.

Perforated line forming blades 22 and 22 are respectively provided on the cutter lines 21*e*1 and 21*e*2. For the perforated line forming blades 22 and 22, blades having needles, each needle having a sharp and conical leading edge with a diameter of approximately 1.2 mm, may be used. A forming speed of the perforated lines may be set approximately 300 m for each 1 minute. (A feeding speed for forming the perforated lines may be 300 m/1 min.)

Fourth Embodiment

Figure 11:
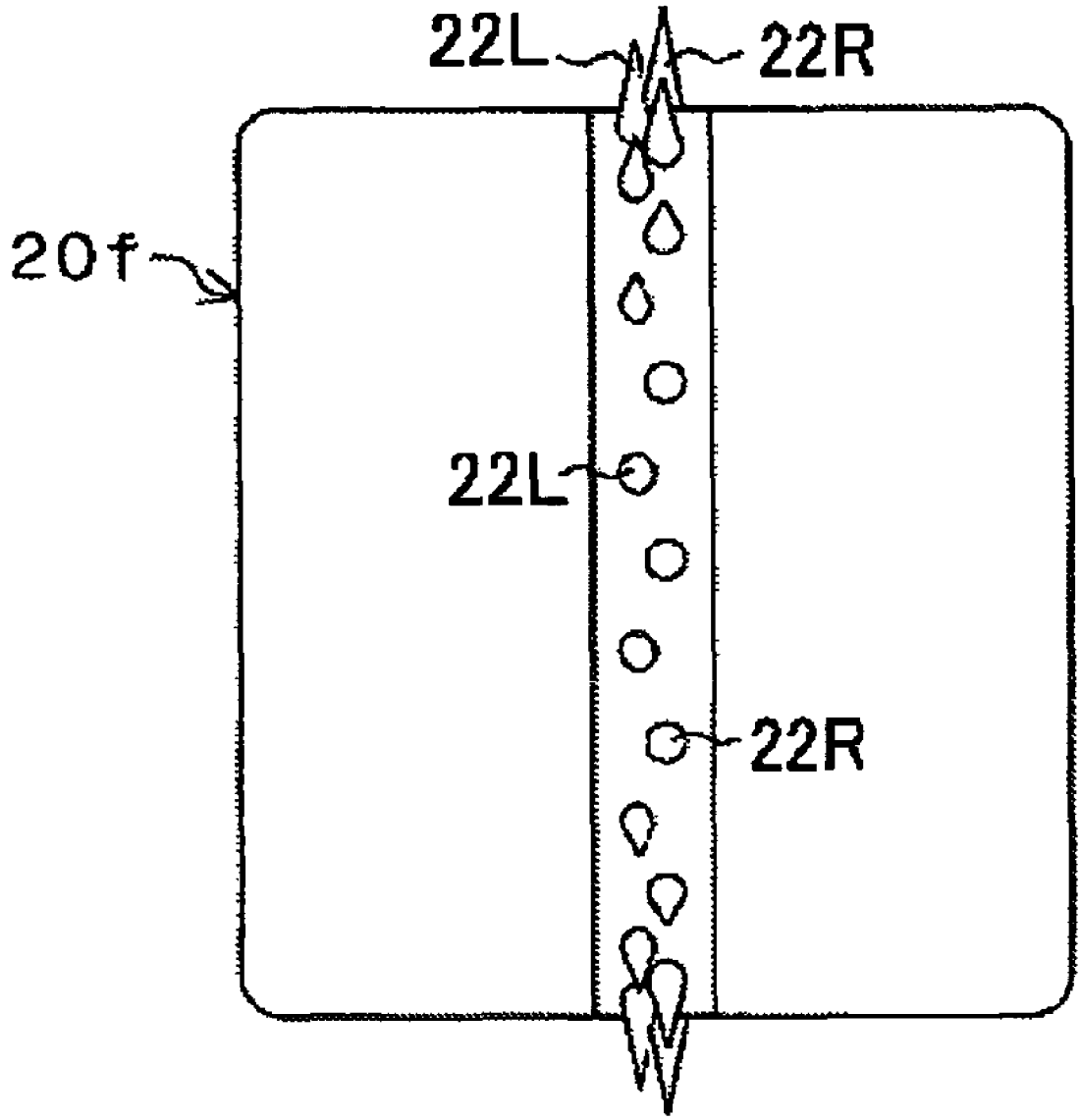
FIG. 11 is a plan view showing a cutter roller according to one or more embodiments of the present invention.

Disclosed in FIG. 11 is a cutter roller 20*f* according to fourth embodiment. In the cutter roller 20*f*, since an interval between adjacent cutter lines is narrow, and perforated line forming blades 22L and 22R of the adjacent cutter lines with shifted phases are formed in positions overlapping each other in a circumferential direction. In another words, the cutter roller 20*f* is provided with a plurality of perforated line forming blades 22R and a plurality of perforated line forming blades 22L on an outer circumference thereof. As shown in FIG. 11, in a rotational direction of the cutter roller 20*f*, a first cutter line and a second cutter line are formed so that phases are shifted. Not shown, on an outer circumference of a guide roller, a common peripherall groove is formed for receiving the perforated line forming blades 22R and 22L of the both cutter lines.

Fifth Embodiment

Figure 12:
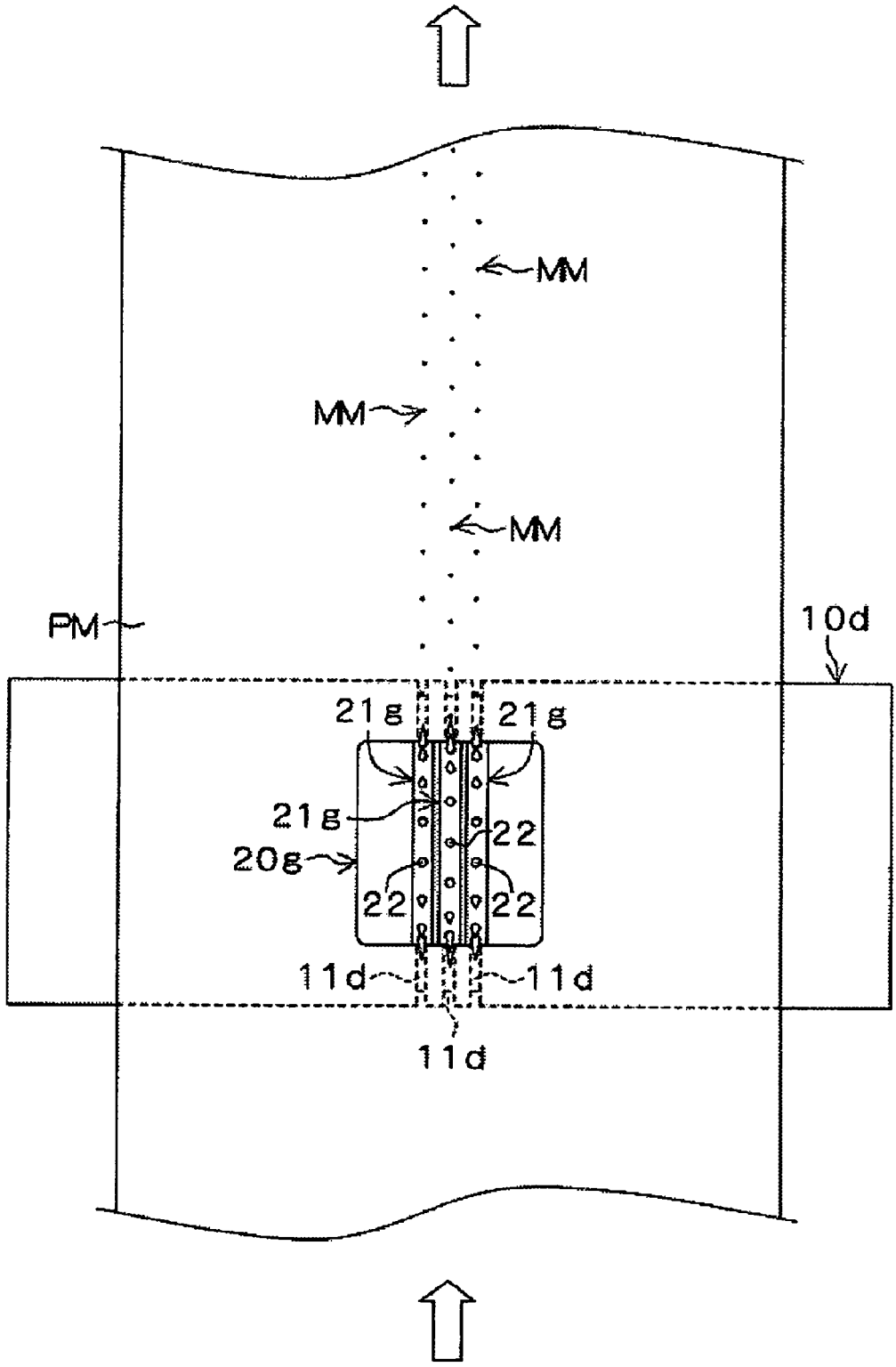
FIG. 12 is a plan view showing a perforated line forming apparatus according to one or more embodiments of the present invention.
Figure 13:
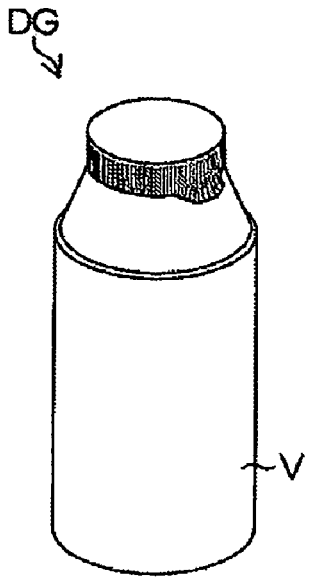
FIG. 13 is a perspective view showing an example of a drink product.
Figure 14:
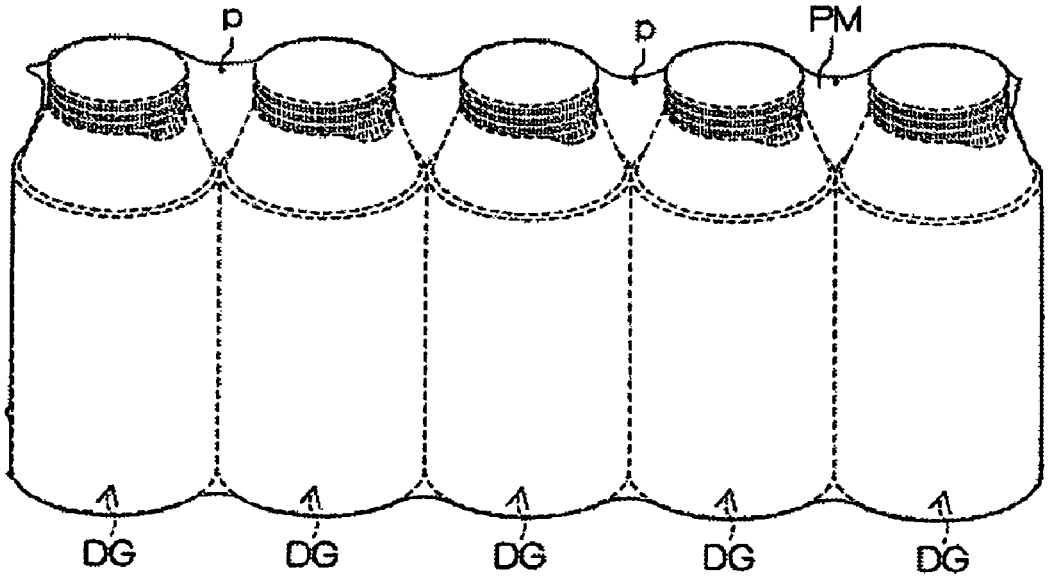
FIG. 14 is a perspective view showing a conventional overwrap packed body obtained by wrapping a plurality of drink products with a wrapping material.
Figure 15:
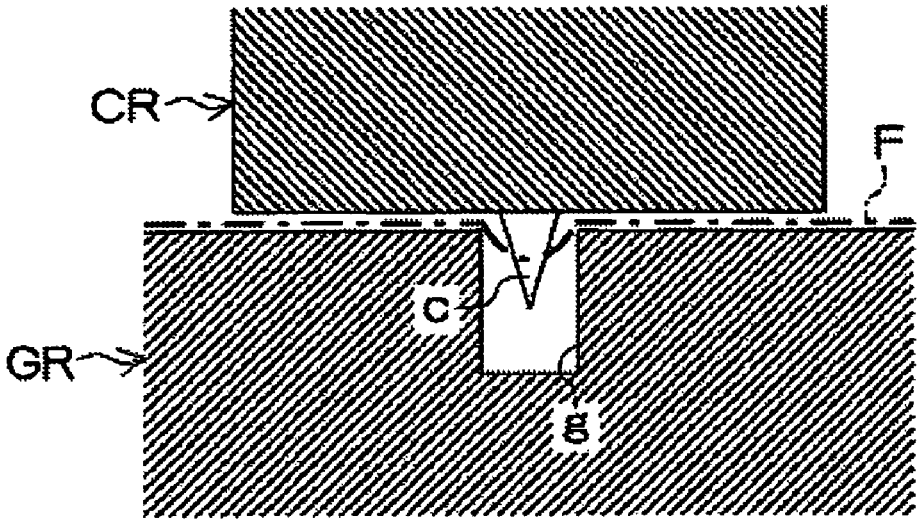
FIG. 15 is a view for explaining a perforated line forming method of forming a perforated line on a film according to related art of the present invention.
Figure 16:
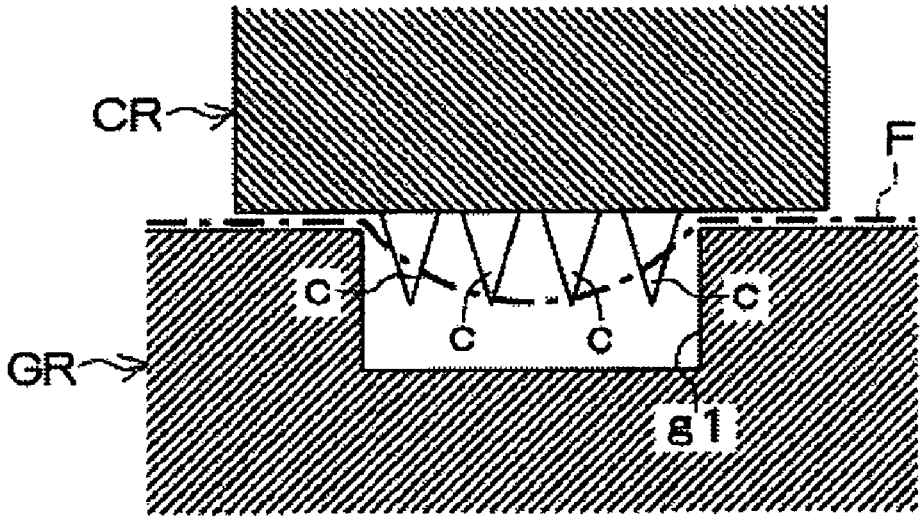
FIG. 16 is a view for explaining the problems of the perforated line forming method according to the related art of the present invention.

In the above mentioned first to fourth embodiments, it is described about the cases that one line or two lines of cutter lines are formed on a single cutter roller, however, the present invention is not limited to them. As shown in FIG. 12, on a single cutter roller 20*g*, three lines of cutter lines 21*g*, 21*g* and 21*g* may be provided by shifting the phases between adjacent perforated line forming blades 22, 22 and 22. Moreover, over four lines of cutter lines may be provided.

While the perforated line MM is formed on the wrapping material PM by using the cutter rollers 20*a* and 20*b* having the perforated line forming blades 22 and the guide rollers 10*a* and 10*b* having the peripheral grooves 11*a* and 11*b* for receiving the perforated line forming blades 22, moreover, this is not restricted but it is also possible to use a receiving object taking the shape of a flat or curved plate which is provided with a groove for receiving the perforated line forming blade 22 in place of the guide rollers 10*a* and 10*b*.

Furthermore, the perforated lines MM on the wrapping material PM can be formed in a slitter process for the wrapping material PM or a wrapping process using a pillow wrapping machine.

It will be apparent to those skilled in the art that various modifications and variations can be made to the described preferred embodiments of the present invention without departing from the spirit or scope of the invention. Thus, it is intended that the present invention coverall modifications and variations of this invention consistent with the scope of the appended claims and their equivalents.

The present application claims a priority based on a Japanese Patent Application (P.2004-119103) filed on Jul. 7, 2004, the contents of which are incorporated herein by reference.

INDUSTRIAL APPLICABILITY

In the overwrap packed body according to one or more embodiments of the present invention, the perforated lines passing through the gap portion between the adjacent objects to be packed are formed on the wrapping material in parallel. In the gap portion between the adjacent objects to be packed in the packing material, therefore, the wrapping material is broken in the perforated line portions when they are pushed with fingers. Thus, it is possible to easily take out the packed object.

In the overwrap packed body, moreover, the perforated line is used as a staring point for tearing the wrapping material. Differently from a conventional overwrap packed body using a small hole as a starting point for tearing the wrapping material, therefore, it is possible to reliably form the portion for tearing the wrapping material in the gap portion between the adjacent objects to be packed without requiring to consider the positional shift of the wrapping material in the adjacent direction of the packed object.

Furthermore, in the overwrap packed body according to one or more embodiment of the present invention, the perforated lines are formed in parallel at a small interval of 1 to 3 mm as a starting point for tearing the wrapping material. As compared with the conventional overwrap packed body provided with only one small hole as a starting point for tearing the wrapping material, therefore, a breaking property can be more enhanced.

Moreover, in the overwrap packed body according to one or more embodiments of the present invention, the phases of the adjacent perforated lines are shifted from each other. Therefore, it is possible to form the adjacent perforated lines at the same time even if the interval between the adjacent perforated lines to be formed is small.

Moreover, in the perforated line forming method according to one or more embodiments of the present invention, the perforated lines are formed stepwise in such a manner that the adjacent perforated lines are not formed at the same time. Also in the case in which the interval between the perforated lines to be formed on the film is small, therefore, it is possible to form the peripheral groove for receiving the perforated line forming blade of the cutter roller on the guide roller in an independent state for each of the perforated line forming blades.

When the perforated line forming blade is to stick to the film, accordingly, the amount of elongation and that of shift in the film can be minimized. Therefore, it is possible to reliably form a proper perforated line without decreasing the amount of sticking of the perforated line forming blade to the film.

When a plurality of perforated lines which is close to each other is to be formed, moreover, the adjacent perforated lines are prevented from being formed at the same time. Consequently, the film is broken with difficulty at a cut constituting the perforated line. Consequently, it is also possible to obtain an advantage that a fine perforated line can be formed without damaging the film.

The perforated line forming method is useful for a method of forming a plurality of perforated lines which wraps a plurality of objects to be wrapped by a wrapping material constituted by a biaxially stretched film having a thermal shrinking property to carry out overwrap packing and pushing, with fingers, a gap portion between the overwrap packed bodies thus obtained, thereby breaking and opening the wrapping material. In particular, the method is suitable for the case in which two to four perforated lines are formed in parallel at a small interval of approximately 1 to 3 mm over a thin wrapping material having a thickness of 10 to 30 μm.

The invention claimed is:

1. An overwrap packed body comprising:

a plurality of packed objects, wherein each of the packed objects comprises:

a top surface extending in a horizontal direction, a cylindrical portion having an axis extending in a vertical direction, and an inclined shoulder portion provided between the top surface and the cylindrical portion;

a wrapping material that wraps the plurality of packed objects, wherein the plurality of packed objects are arranged adjacent to each other and in line in said horizontal direction; and a plurality of adjacent perforated lines formed in parallel in the wrapping material and passing through a gap portion between adjacent packed objects, wherein the plurality of adjacent perforated lines extend in said horizontal direction against the inclined shoulder portions of the packed objects, wherein the plurality of adjacent perforated lines are formed in a position apart from the top surfaces of the packed objects in the vertical direction on a single side of a plane which substantially includes the entire axis of each of said packed objects, and wherein the wrapping material comprises a film having a thermal shrinking property.

2. The overwrap packed body according to claim 1, wherein an interval between adjacent ones of the plurality of perforated lines is 1 to 3 mm.

3. The overwrap packed body according to claim 1, wherein each of the plurality of perforated lines comprises a plurality of cuts arranged in line, and the plurality of cuts are formed at a pitch of 0.5 to 3.0 mm.

4. The overwrap packed body according to claim 1, wherein phases of adjacent ones of the plurality of perforated lines are shifted from each other.

5. The overwrap packed body according to claim 1, wherein the wrapping material fully encloses the plurality of packed objects.

6. The overwrap packed body according to claim 1 further comprising a second plurality of adjacent perforated lines formed on a different side of the plane from said plurality of perforated lines.

* * * * *